US011559185B2

(12) United States Patent
Elkhoury et al.

(10) Patent No.: US 11,559,185 B2
(45) Date of Patent: Jan. 24, 2023

(54) RACK ADJUSTER

(71) Applicant: ILLINOIS TOOL WORKS INC., Glenview, IL (US)

(72) Inventors: Massoud Elkhoury, Bloomingdale, IL (US); Michael Osvatic, Waukesha, WI (US); William S. Poehls, Hartland, WI (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/172,841

(22) Filed: Feb. 10, 2021

(65) Prior Publication Data

US 2021/0244258 A1 Aug. 12, 2021

Related U.S. Application Data

(60) Provisional application No. 62/972,982, filed on Feb. 11, 2020.

(51) Int. Cl.
*A47L 15/50* (2006.01)

(52) U.S. Cl.
CPC ..... *A47L 15/504* (2013.01)

(58) Field of Classification Search
CPC ..... A47L 15/50; A47L 15/501; A47L 15/503; A47L 15/504; A47L 15/506; A47L 15/507
USPC ..... 211/41.1–41.9
See application file for complete search history.

(56) References Cited

U.S. PATENT DOCUMENTS 3,809,450 A * 5/1974 Guth ..... A47L 15/504 312/351
3,822,085 A * 7/1974 Clark ..... A47L 15/504 312/351
5,595,200 A * 1/1997 Favaro ..... A47L 15/504 134/201
5,657,878 A * 8/1997 Austin ..... A47L 15/504 211/208
7,410,228 B2 * 8/2008 Dickson ..... A47L 15/504 211/41.9
8,191,560 B2 * 6/2012 Mallory ..... A47L 15/503 134/145
8,534,471 B2 * 9/2013 Wong ..... A47L 15/504 211/41.8
8,567,882 B1 10/2013 Garnett
(Continued)

OTHER PUBLICATIONS

U.S. Patent Office, English language version of the International Search Report, Form PCT/ISA/210 for International Application PCT/US2021/017627, dated May 10, 2021 (5 pages).
(Continued)

*Primary Examiner* — Patrick D Hawn
(74) *Attorney, Agent, or Firm* — Pauley Erickson & Swanson

(57) ABSTRACT

A system and method for adjusting a dishwasher rack in a dishwasher includes a base, a slider and a lock for raising and lowering a dishwasher basket between an up and down position, respectively. The slider is connected in a fixed engagement with the dishwasher basket. The base includes two or more rollers for engagement with dishwasher slide rails and is slideably engaged relative to the slider. The lock is biased into a locked position when the base is fully upwardly extended relative to the slider and is released to permit the basket to be lowered downwardly.

11 Claims, 10 Drawing Sheets

(56) References Cited

U.S. PATENT DOCUMENTS

| | | | | |
|---|---|---|---|---|
| 8,813,766 | B2 * | 8/2014 | Bhajak | A47L 15/504 134/135 |
| 8,840,201 | B2 * | 9/2014 | Garnett | A47L 15/504 312/228.1 |
| 9,004,082 | B2 * | 4/2015 | Bhajak | A47L 15/504 134/135 |
| 9,579,009 | B2 * | 2/2017 | Bhajak | A47L 15/504 |
| 10,136,795 | B2 * | 11/2018 | Nowell, Jr. | A47L 15/504 |
| 10,383,506 | B2 * | 8/2019 | Minniti | A47B 88/407 |
| 10,582,829 | B2 * | 3/2020 | Hansen | A47L 15/507 |
| 10,602,909 | B2 * | 3/2020 | Gupta | A47L 15/507 |
| 2004/0103932 | A1 * | 6/2004 | Kim | A47L 15/504 134/137 |
| 2005/0039782 | A1 * | 2/2005 | Kim | A47L 15/504 134/58 D |
| 2005/0133469 | A1 * | 6/2005 | Mersch | A47L 15/504 211/41.8 |
| 2006/0237042 | A1 * | 10/2006 | Weaver | A47L 15/504 134/25.2 |
| 2008/0272072 | A1 | 11/2008 | Tynes et al. | |
| 2010/0314977 | A1 * | 12/2010 | Mallory | A47L 15/503 312/228.1 |
| 2011/0018410 | A1 * | 1/2011 | Bastuji | A47L 15/504 312/228.1 |
| 2014/0217868 | A1 * | 8/2014 | Bhajak | A47L 15/50 312/228.1 |
| 2016/0331204 | A1 | 11/2016 | Kutto et al. | |
| 2017/0265713 | A1 * | 9/2017 | Kopyrin | A47L 15/504 |
| 2018/0289236 | A1 * | 10/2018 | Minniti | A47B 88/407 |
| 2019/0125161 | A1 * | 5/2019 | Hansen | A47L 15/46 |
| 2019/0269297 | A1 * | 9/2019 | Gupta | A47B 57/26 |
| 2019/0350434 | A1 * | 11/2019 | Singhal | A47L 15/503 |

OTHER PUBLICATIONS

U.S. Patent Office, English language version of the Written Opinion of the ISA, Form PCT/ISA/237 for International Application PCT/US2021/017627, dated May 10, 2021 (8 pages).

* cited by examiner

RACK ADJUSTER

CROSS REFERENCE TO RELATED APPLICATION

This application claims the benefit of U.S. provisional application, Ser. No. 62/972,982, filed on 11 Feb. 2020. The parent application is hereby incorporated by reference herein in its entirety and is made a part hereof, including but not limited to those portions which specifically appear hereinafter.

BACKGROUND OF THE INVENTION

Field of the Invention

The invention is directed to a rack adjuster tor adjusting a dishwasher rack between an up position and a down position.

Description of Related Art

Dishwashers generally include slideable racks that move in and out of position to enable loading and unloading. Some dishwashers come equipped with slideable racks that are moveable up and down to accommodate different sized dishes and utensils. Existing adjustable racks typically include a unique left- and right-hand adjuster mechanism which complicates production and repair.

SUMMARY OF THE INVENTION

The present invention relates to a rack adjuster for a dishwasher rack for raising and lowering the dishwasher rack between an up position and a down position, respectively. A traditional dishwasher rack includes a basket that slides in and out of the dishwasher along a pair of slide arms.

According to one preferred embodiment, a slider is connected in a fixed engagement to the basket. The basket is further connected with the slide arms of the dishwasher to permit the basket to slide in and out of the dishwasher.

A base is slideably engaged relative to the slider. The base preferably includes two or more rollers to engage and slide relative to the slide arms of the dishwasher. A lock is connected between the base and the slider and is preferably biased into a locked position when the base is fully extended relative to the slider—in an "up" position. In an unlocked, or "down" position, the lock permits the slider to slide relative to the base.

In the manner of the invention described, a common set of components including the slider, the base and the lock, may be utilized on both the right side and the left side of the basket to simply manufacture and repair of the dishwasher.

Further objects and advantages to the invention will be apparent from the following detailed description of preferred embodiments and from the accompanying drawings.

BRIEF DESCRIPTION OF THE DRAWINGS

Objects and features of this invention will be better understood from the following description taken in conjunction with the drawings, wherein.

As will be appreciated, certain standard elements not necessary for an understanding of the invention may have been omitted or removed from the drawings for purposes of facilitating illustration and comprehension.

DETAILED DESCRIPTION

Figure 1:
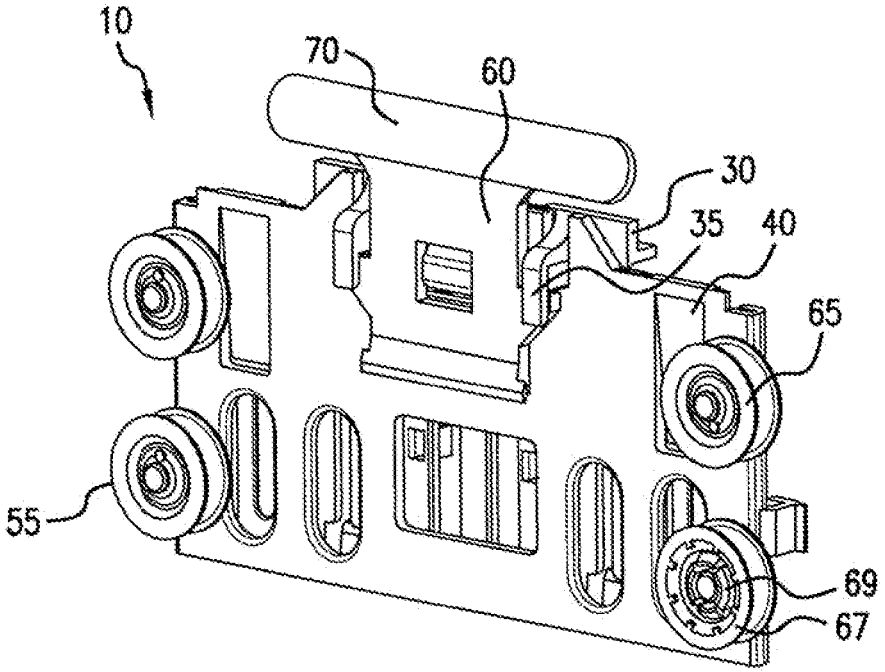
FIG. 1 is front perspective view of a rack adjuster according to one preferred embodiment of the invention.
Figure 2:
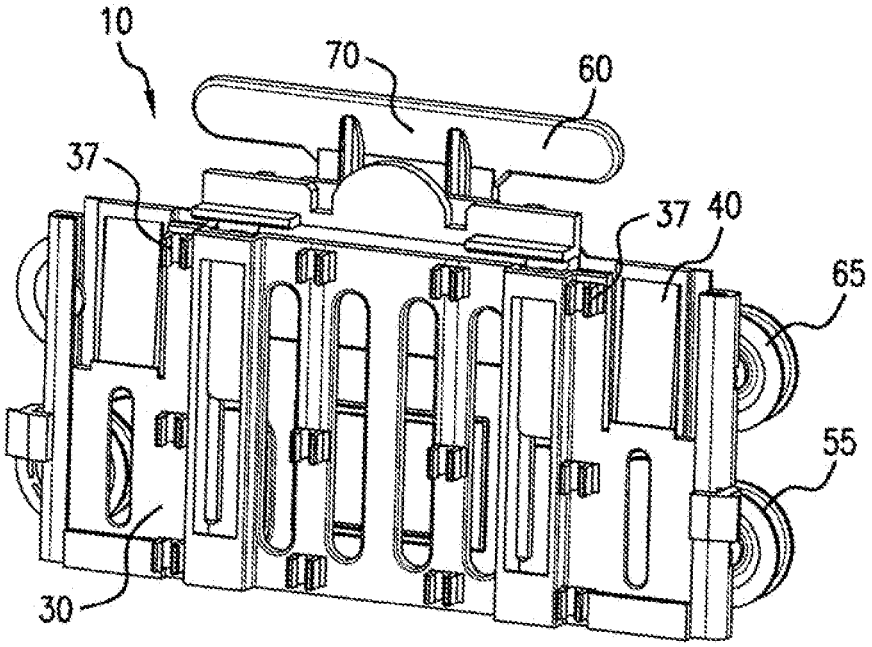
FIG. 2 is a rear perspective view of the rack adjuster shown in FIG. 1.
Figure 3:
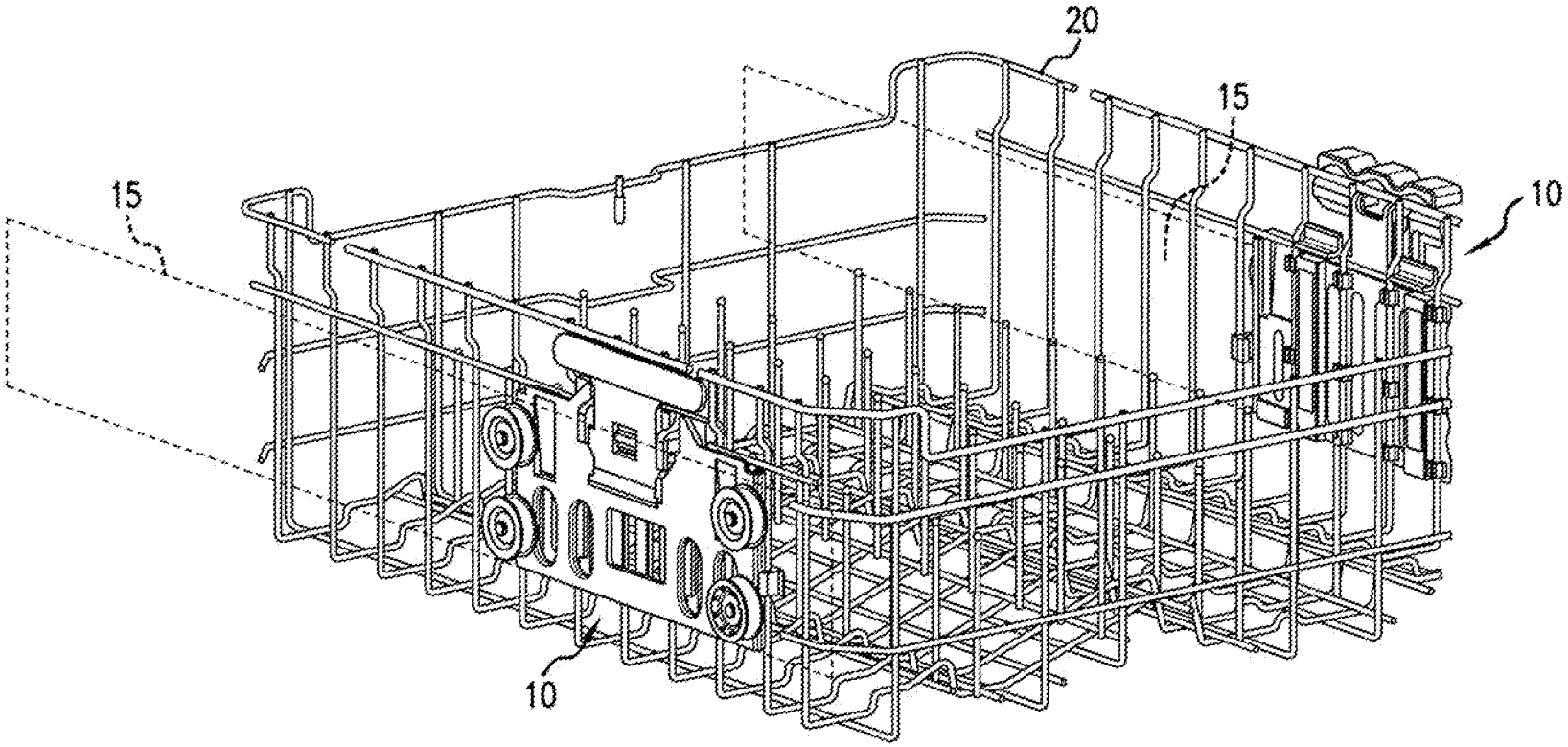
FIG. 3 is a front perspective view of a dishwasher rack in a down position according to one preferred embodiment of the invention.
Figure 4:
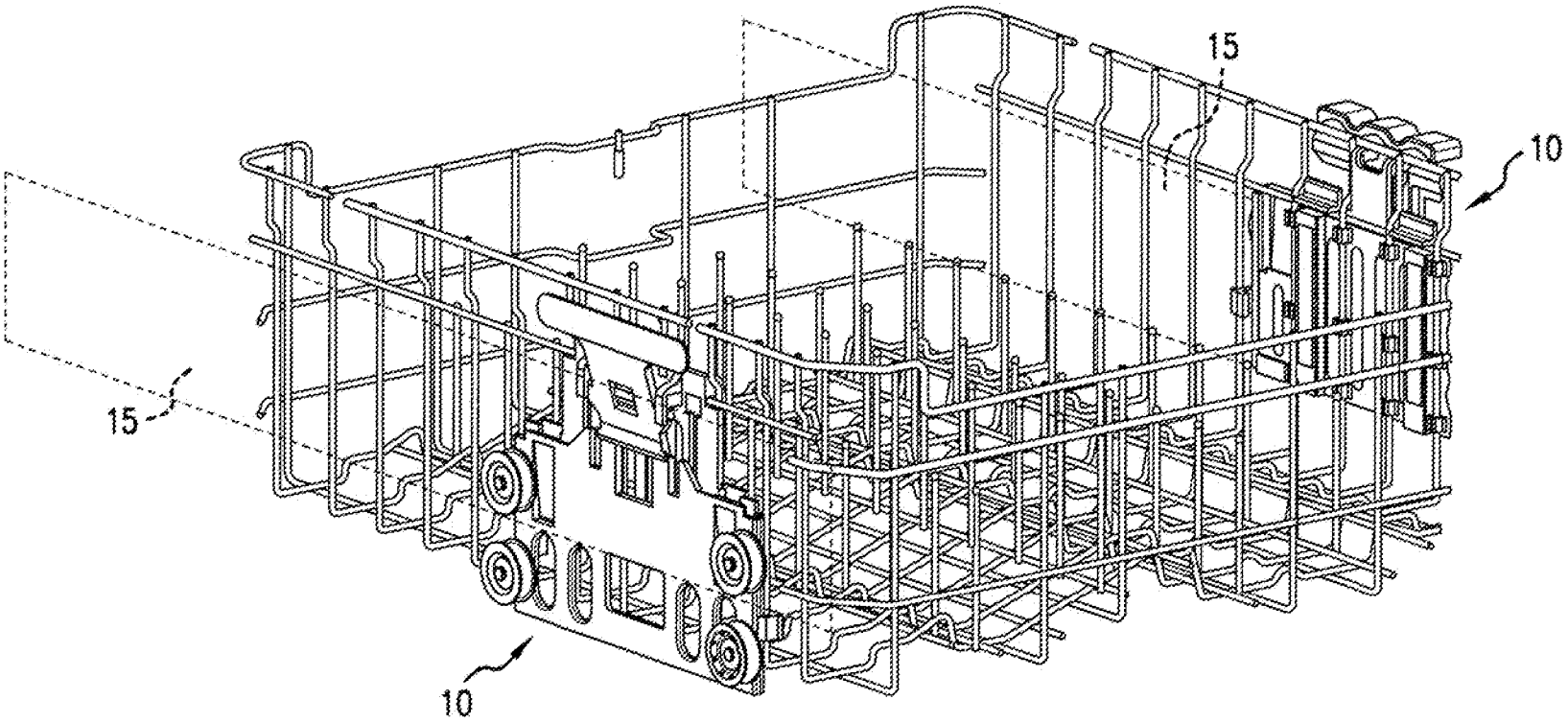
FIG. 4 is a front perspective view of the dishwasher rack of FIG. 3 in an up position.

FIGS. 1 and 2 illustrate a rack adjuster 10 for a dishwasher rack for raising and lowering the dishwasher rack between an up position and a down position, respectively. A traditional dishwasher rack includes a basket 20 that slides in and out of the dishwasher along a pair of slide arms 15, as shown in FIGS. 3 and 4. The basket 20 accommodates dishes and utensils and is slideable between in and out of the dishwasher and, with the rack adjuster 10 according to this invention, upward and downward, depending on the size and configuration of the dishes and utensils. The rack adjuster 10 preferably minimally includes a slider 30, a base 40 and a lock 60.

According to one preferred embodiment, the slider 30 is connected in a fixed engagement to the basket 20. The slider 30 preferably connects to the basket 20 along a plurality of parallel clips 37. Specifically, multiple rows of integrated clips may be formed in the slider 30 that permit the slider 30 to engage securely with the basket 20. In this way, the basket 20 is connected with the slide arms 15 of the dishwasher to permit the basket 20 to slide in and out of the dishwasher. As a result of multiple attachment points between the sliders 30 positioned on each side of the basket 20, a rigid and supportive structure is created to withstand the weight of a loaded basket 20 and the movement of the basket 20 relative to the dishwasher.

A base 40 is slideably engaged with the slider 30. The base 40 preferably includes two or more rollers 55 to engage and slide relative to the slide arms 15 of the dishwasher. In this manner, the base 40 is preferably slideable in a vertical manner relative to the slider 30 and is slideable in a horizontal manner with and/or relative to the slide arms 15. According to one embodiment, the slider 30 includes a latch 35 that extends through the base 40, such as through a gap or notch provided in the base 40.

Figure 5A:
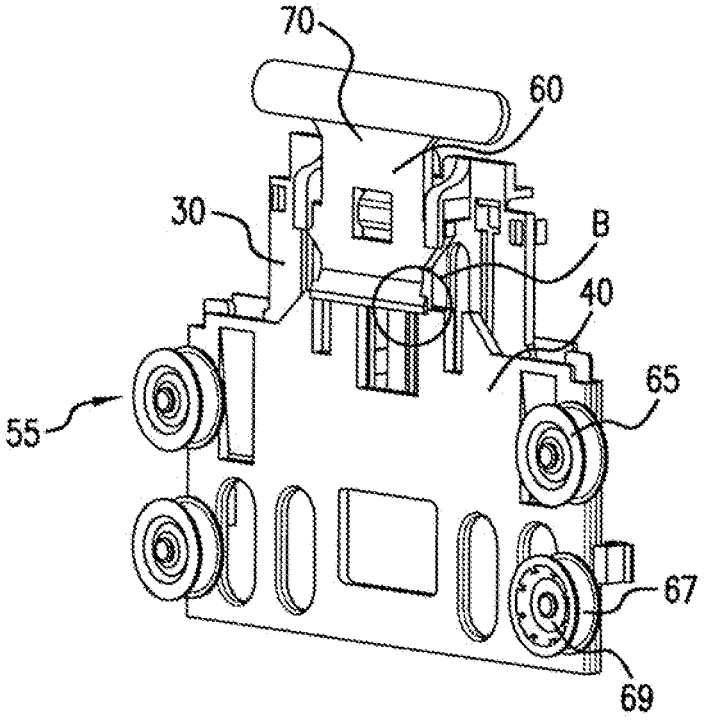
FIG. 5A is a front perspective view of the rack adjuster shown in FIG. 1 in an up position according one preferred embodiment of the invention.
Figure 5B:
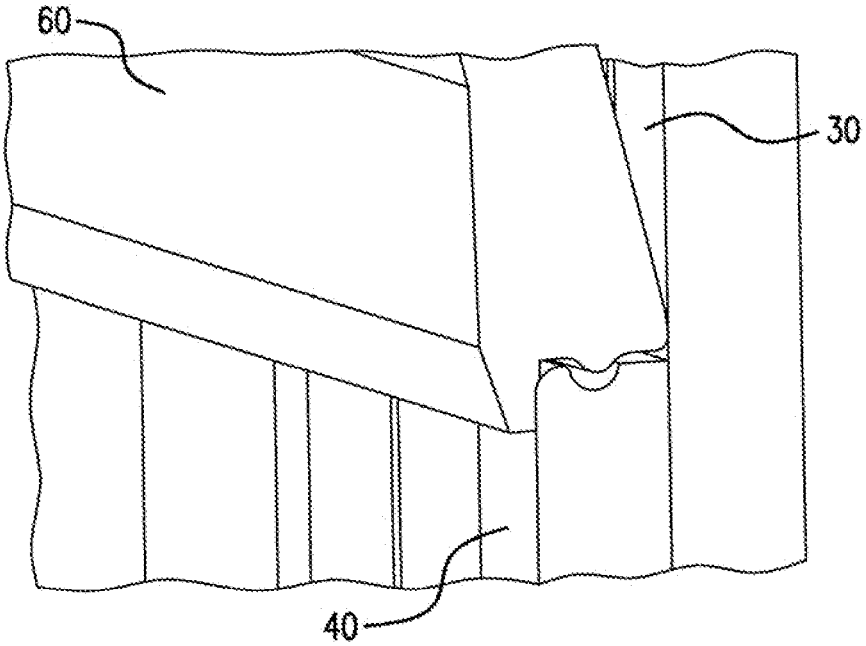
FIG. 5B is a detail view of section B shown in FIG. 5A.

A lock 60 is connected between the base 40 and the slider 30 and is preferably biased into a locked position when the base 40 is fully extended relative to the slider 30—in an "up" position. In an unlocked, or "down" position, the lock 60 engages the latch 35 to permit the slider 30 to slide relative to the base 40. As best shown in FIG. 5A and, in detail, in FIG. 5B, the lock 60 is preferably biased into a locking engagement with a portion of the base 40 when the rack adjuster 10 is in the up position. From this up position, the lock 360 may be released from the portion of the base 40 by biasing a spring 80 and permitting the base 40 to slide downward relative to the slider 30.

Figure 6:
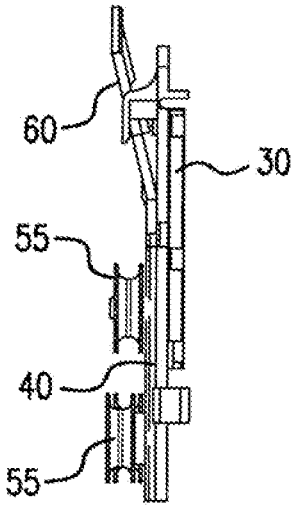
FIG. 6 is a side view of the rack adjuster shown in FIG. 1 in an up position.
Figure 7:
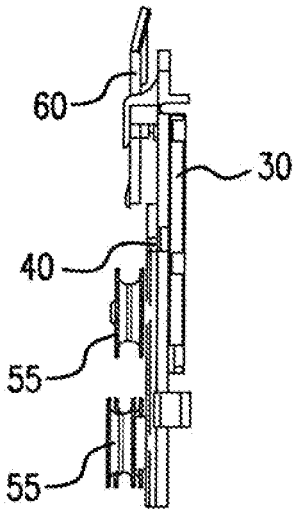
FIG. 7 is a side view of the rack adjuster shown in FIG. 1 in an up position with the handle deployed.
Figure 8:
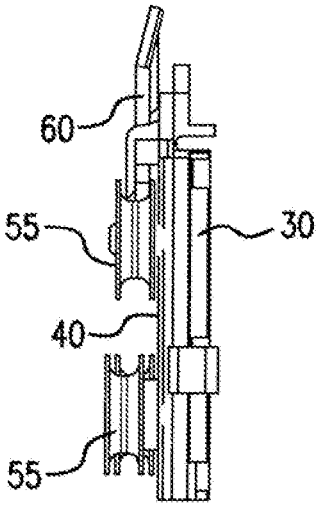
FIG. 8 is a side view of the rack adjuster shown in FIG. 1 in a down position.
Figure 9:
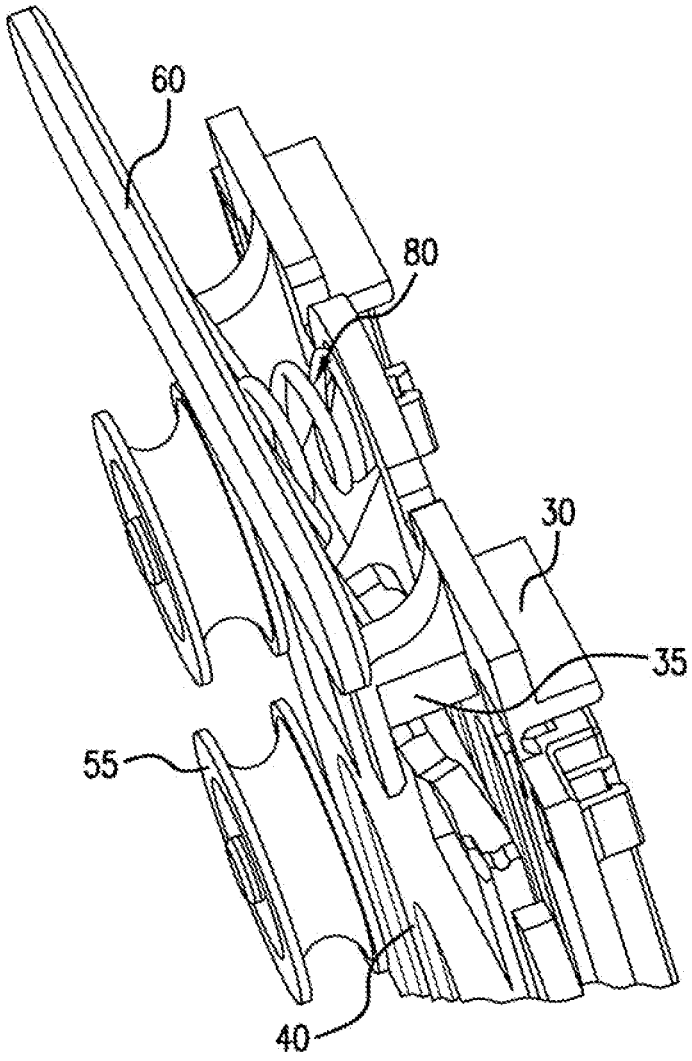
FIG. 9 is a top perspective view of the rack adjuster shown in FIG. 1 in an up position.

As best shown in FIGS. 6-8, the lock 60 preferably comprises a pivotable handle 70 having an upper end and a lower end, wherein the handle 70 is biased inwardly toward the rack adjuster 10 at a lower end.

Figure 10:
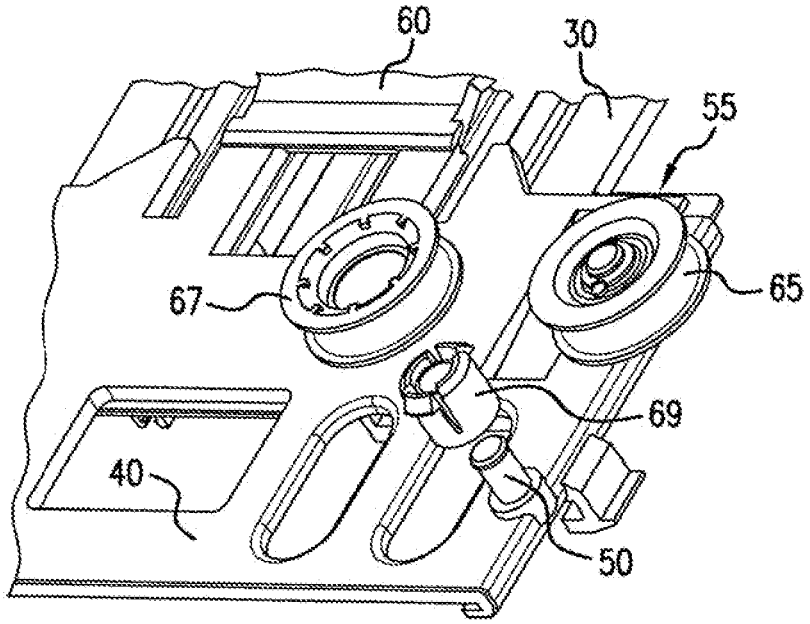
FIG. 10 is a perspective view of a wheel connection system of the rack adjuster shown in FIG. 1.
Figure 11:
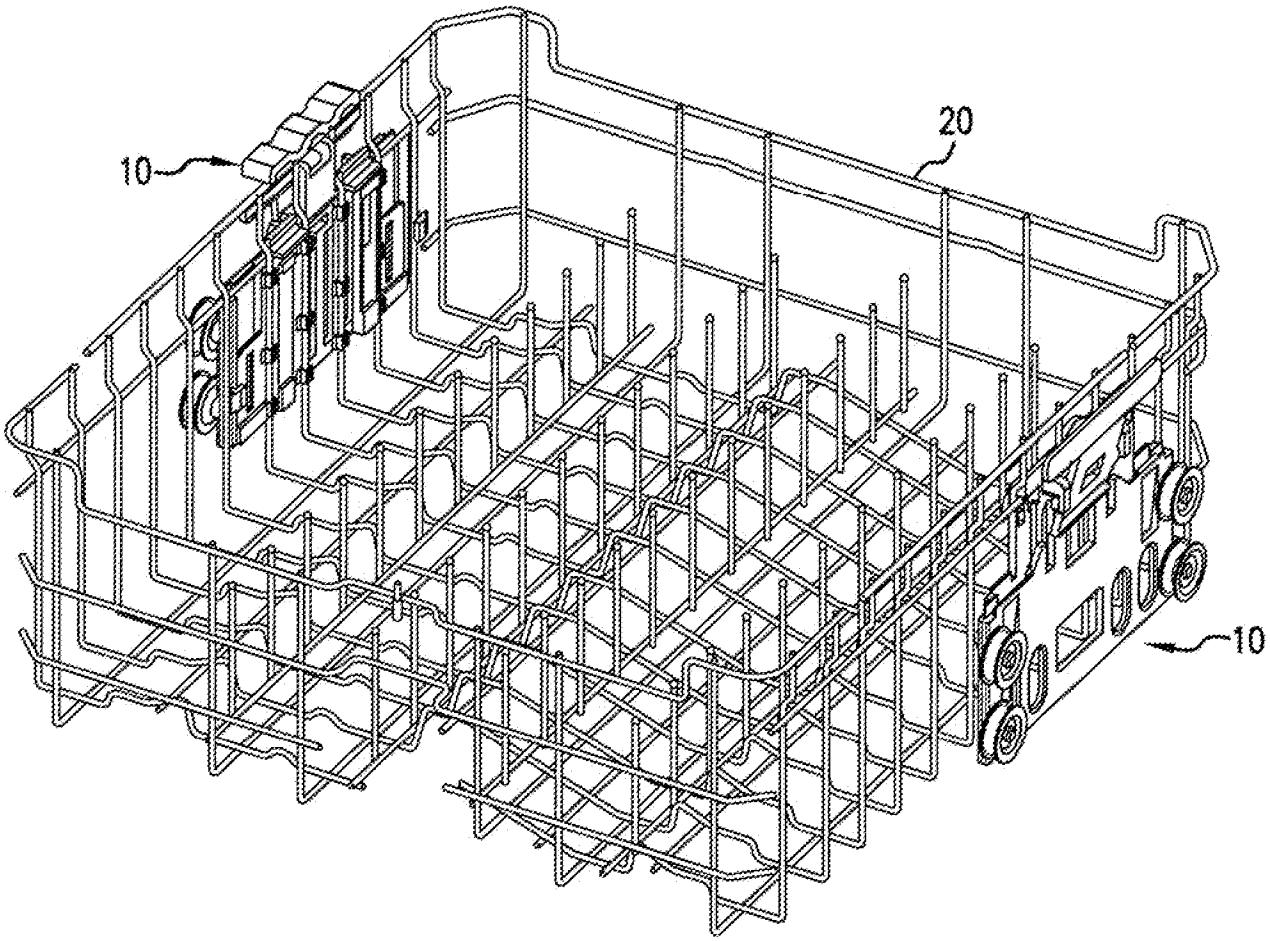
FIG. 11 is a rear perspective view of the dishwasher rack of FIG. 3 in the up position.

As best shown in FIG. 10, the base 40 preferably includes two or more shafts 50 for accommodating the rollers 55. The shafts 50 are preferably integrated with the base 40 to permit attachment of standard bearings 65 or specialty wheels 67 that are adapted for attachment to the shaft 50 through the use of a coupler 69.

In the described embodiments, the rack adjuster 10 is preferably useable on both the right and left sides of the basket without change. In this way, identical components may be used for each of the right and left side of the dishwasher rack thereby simplifying manufacture and repair.

A preferred embodiment of this invention includes an adjustable dishwasher rack having a basket 20 to accommodate dishes and utensils. A slider 30 is fixed to each of a left side and a right side of the basket 20. A base 40 is connected to each slider 30, so that the base 40 is slideable relative to the slider 30 and vice-versa. A handle 70 is connected to each base 40, wherein each slider 30, base 40 and handle 70 is interchangeable between the right side of the basket 20 and the left side of the basket 20.

The adjustable dishwasher rack is configured such that the slider 30 includes a latch 35 that extends through the base 40, wherein the latch 35 engages the lock to permit the slider 30 to slide relative to the base 40. The base 40, and thus the basket 20, is preferably moveable from a down position to an up position without releasing the lock 60. The base 40, and thus the basket 20, is then moveable from the up position to the down position by releasing the lock 60.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

Although specific advantages have been enumerated above, various embodiments may include some, none, or all of the enumerated advantages.

The invention illustratively disclosed herein suitably may be practiced in the absence of any element, part, step, component, or ingredient which is not specifically disclosed herein.

The claims are not intended to include, and should not be interpreted to include, means-plus- or step-plus-function limitations, unless such a limitation is explicitly recited in a given claim using the phrase(s) "means for" or "step for," respectively.

What is claimed is:

1. A rack adjuster for a dishwasher rack for raising and lowering a dishwasher basket in an up and down position, respectively, the rack adjuster comprising:

a slider connected in a fixed engagement with the dishwasher basket;

a base having two pair of vertically aligned rollers, each roller of the rollers connected with shafts and bearings permitting free rotation of the roller, the base slideably engaged with the slider and spaced apart from the dishwasher basket, wherein the base moves vertically relative to the slider between an up position and a down position; and a lock spaced between the slider and the base, the lock biased into a locked position when the base is fully extended in the up position relative to the slider, wherein the slider, the base and the lock are all positioned outside of the basket, and wherein the slider includes a latch that extends through the base, wherein the latch engages the lock to permit the slider to slide relative to the base.

2. The rack adjuster of claim 1 wherein the slider connects to the rack along a plurality of parallel clips.

3. The rack adjuster of claim 1 wherein the lock is biased into a locking engagement with a portion of the base when the rack adjuster is in the up position.

4. The rack adjuster of claim 3 wherein the lock is released from the portion of the base by biasing a coil spring, the coil spring compressed between the lock and a portion of the slider.

5. The rack adjuster of claim 1 wherein the lock comprises a pivotable handle having an upper end and a lower end, the handle biased inward at a lower end.

6. The rack adjuster of claim 1 wherein the base further comprises two or more shafts for accommodating the rollers.

7. The rack adjuster of claim 1 comprising identical components for each of the right and left side of the dishwasher rack.

8. An adjustable dishwasher rack comprising:

a basket;

a slider fixed to each of a left side and a right side of the basket;

a base connected to each slider, spaced apart from the basket, the base vertically slideable relative to the slider; and a lock connected to each base at a midline of the base between the base and the slider, wherein each slider, base and lock is symmetrical across a respective midline of each slider, base and lock, and is therefore interchangeable between the right side of the basket and the left side of the basket, wherein the slider, the base and the lock are all positioned outside of the basket, and wherein the slider includes a latch that extends through the base, wherein the latch engages the lock to permit the slider to slide relative to the base.

9. The adjustable dishwasher rack of claim 8 wherein the lock is biased against the base.

10. The adjustable dishwasher rack of claim 8 wherein the base is moveable from a down position to an up position without releasing the lock.

11. The adjustable dishwasher rack of claim 10 wherein the base is moveable from the up position to the down position by releasing the lock.

* * * * *